US010648325B2

(12) United States Patent
Mulholland et al.

(10) Patent No.: US 10,648,325 B2
(45) **Date of Patent: *May 12, 2020**

(54) WIRELESS DOWNHOLE FEEDTHROUGH SYSTEM

(71) Applicant: FMC Technologies, Inc., Houston, TX (US)

(72) Inventors: John J. Mulholland, Kongsberg (NO); Gabriel Silva, Kingwood, TX (US); David Kane, Edinburgh (GB); Daniel McStay, Aberdeenshire (GB)

(73) Assignee: FMC Technologies, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/027,221

(22) Filed: Jul. 3, 2018

(65) Prior Publication Data

US 2018/0320507 A1 Nov. 8, 2018

Related U.S. Application Data

(63) Continuation of application No. 14/417,098, filed as application No. PCT/US2012/047934 on Jul. 24, 2012, now Pat. No. 10,030,509.

(51) Int. Cl.

| | |
|---|---|
| ***E21B 47/12*** | (2012.01) |
| ***E21B 33/03*** | (2006.01) |
| ***E21B 33/04*** | (2006.01) |
| ***E21B 33/047*** | (2006.01) |

(52) U.S. Cl.
CPC ..... *E21B 47/122* (2013.01); *E21B 33/03* (2013.01); *E21B 33/04* (2013.01); *E21B 33/047* (2013.01); *E21B 47/123* (2013.01)

(58) Field of Classification Search
CPC ..... E21B 47/122; E21B 33/03; E21B 33/04; E21B 33/047; E21B 47/123
See application file for complete search history.

(56) References Cited

U.S. PATENT DOCUMENTS

| | | | | |
|---|---|---|---|---|
| 7,762,338 | B2 | 7/2010 | Fenton | |
| 7,831,205 | B2 * | 11/2010 | Jack | H04B 5/02 136/224 |
| 8,511,389 | B2 | 8/2013 | Fenton | |
| 8,683,859 | B2 | 4/2014 | Godager | |

(Continued)

*Primary Examiner* — Benjamin F Fiorello
(74) *Attorney, Agent, or Firm* — Henry C. Query, Jr.

(57) ABSTRACT

An apparatus for communicating signals across a wellbore barrier defined by a first flow completion system component positioned at an upper end of the wellbore and a second flow completion system component mounted within the first flow completion system component includes a first wireless node which is mounted on the first flow completion system component on a first side of the wellbore barrier, the first wireless node being configured to be connected to an external device, and a second wireless node which is mounted on the second flow completion system component on a second side of the wellbore barrier, the second wireless node being located generally opposite the first wireless node and being configured to be connected to a downhole device. The first and second wireless nodes are configured to communicate wirelessly through the wellbore barrier using near field magnetic induction (NFMI) communications.

8 Claims, 6 Drawing Sheets

(56) References Cited

U.S. PATENT DOCUMENTS

| | | | | |
|---|---|---|---|---|
| 9,435,190 | B2 | 9/2016 | Mulholland et al. | |
| 2003/0076107 | A1* | 4/2003 | Fanini ..... | G01V 3/28<br>324/339 |
| 2009/0066535 | A1 | 3/2009 | Patel et al. | |
| 2016/0341030 | A1 | 11/2016 | Mulholland et al. | |

* cited by examiner

WIRELESS DOWNHOLE FEEDTHROUGH SYSTEM

The present application is a continuation of U.S. patent application Ser. No. 14/417,098 filed on Oct. 15, 2015, which is a U.S. national stage filing of International Patent Application No. PCT/US2012/047934 filed on Jul. 24, 2012.

FIELD OF THE INVENTION

The present invention relates to a flow completion system for producing oil and/or gas from a subterranean well. More particularly, the invention relates to a downhole feedthrough system for communicating wirelessly through a wellbore barrier in the flow completion system.

BACKGROUND OF THE INVENTION

Flow completion systems typically include a wellhead which is positioned at an upper end of the wellbore and a tubing hanger which is landed in the wellhead or in a christmas tree that is mounted to the top of the wellhead. In such systems the wellhead and the christmas tree together with the tubing hanger form a pressure-containing barrier between the wellbore and the surrounding environment. This pressure barrier must be maintained at all times during operation of the flow completion system in order to prevent well fluids from leaking into the surrounding environment.

Flow completion systems usually include a number of downhole devices which need to be accessed from an exterior location. For example, a monitoring and control system located, e.g., on a surface vessel commonly receives inputs from a number of downhole sensors. The downhole sensors are typically connected to corresponding downhole data and/or power cables. In order to provide for communication between the monitoring and control system and the downhole sensors, the downhole data and/or power cables must normally be connected to corresponding external data and/or power cables which in turn are connected to the monitoring and control system.

One way of connecting the downhole cables to their corresponding external cables is through the use of a downhole feedthrough system. A typical downhole feedthrough system includes a penetrator which is mounted on the wellhead or christmas tree. One end of the penetrator is connected to the external data and/or power cables and the other end extends through a feedthrough port in the christmas tree or wellhead and engages a connector which is mounted in the tubing hanger. The connector in turn is connected to a number of data and/or power cables which are positioned in axial feedthrough bores in the tubing hanger and are connected to the downhole data and/or power cables by additional connectors.

However, this type of arrangement is undesirable for several reasons. First, the feedthrough port in the christmas tree or wellhead and the feedthrough bore in the tubing hanger denigrate the critical pressure barriers provided by these components. Second, in order to seal the potential leak path posed by the feedthrough port in the christmas tree or wellhead, the penetrator must be provided with several robust sealing systems, and this complicates the design and increases the cost of the penetrator. Third, the relatively large size of the penetrator limits the number of penetrators which may be incorporated into a typical flow completion system, and this in turn limits the number of downhole lines which can be employed in the system. Fourth, since tubing hangers typically have limited space available for feedthrough bores, the number of downhole lines which can be accessed through the tubing hanger is restricted.

Present day flow completion systems typically must be designed with the ability to measure various wellbore parameters such as temperature, pressure and flow in order to provide the operator with an understanding of the conditions in the wellbore and the reservoir. Although many sensor types are available for such measurements, the harsh wellbore environment prohibits the use of off-the-shelf devices. The operating environment for wellbore sensors may include temperatures of up to 300° C. and pressures of up to 15,000 psi, as well as a variety of production fluids, which are often loaded with abrasive sand and rock fragments. Until recently, wellbore measurements were largely performed using specially constructed electronic sensors. Although many of these devices are highly sensitive and accurate, the harsh wellbore conditions, particularly the elevated temperatures, can reduce their operational lifetime or restrict their use. The elevated temperatures can also cause problems in communicating with the sensors using electrical cables. Consequently, only a relatively small number of electronic sensors are typically deployed, thus limiting the type and amount of information that may be provided.

One solution to this problem has been to employ fiber optic sensors to measure wellbore parameters. Optical fiber sensor and communication systems are much more compatible with the downhole environment. Optical fiber sensors offer the ability to provide both point and distributed wellbore sensing systems which are capable of generating the real time data required for effective optimization of the hydrocarbon production process. A number of optical fiber point sensors have been developed for wellbore sensing applications, examples of which include Bragg grating-based temperature, pressure, strain and flow measurement sensors. Such sensors may, for example, be used to monitor temperature at discrete locations, the strain on a well casing and the position of a sliding sleeve valve. Examples of optical fiber distributed sensors include those which use Raman scattering for measuring temperature and Brillouin scattering for measuring temperature and strain. Such measurements may be used to determine the temperature profile of a well and may, for example, provide real-time assessment of inflow or injection distribution.

An example of a prior art downhole feedthrough system for a fiber optic sensor system is shown schematically in FIG. 1. The downhole feedthrough system is shown installed on a flow completion system 10 which comprises a christmas tree 12 located at the top of a wellbore, a tubing hanger 14 landed in the christmas tree and a tubing string 16 connected to the bottom of the tubing hanger. The optical downhole feedthrough system provides for communication of optical signals between one or more downhole fiber optic sensing device 18 and an external fiber optic cable 20 which is connected to a monitoring and control system located, for example, on a surface vessel (not shown). The optical downhole feedthrough system includes a penetrator assembly 22 which is mounted to the outer surface of the christmas tree 12. The penetrator 22 includes a fiber optic cable 24 having a first end which is connected to the external cable 20 via a conventional dry mate connector 26 and a second end which is connected to a first wet mate connector 28. The first wet mate connector 28 is supported on a movable stem 30 which when the penetrator 22 is actuated moves the first wet mate connector through a feedthrough port 32 in the christmas tree 12 and into connection with a second wet mate connector 34 mounted in the tubing hanger 14. The second wet mate connector 34 is connected to a fiber optic cable 36 which is positioned in an axial feedthrough bore 38 in the tubing hanger 14 and is connected via a pair of dry mate connectors 40, 42 to a downhole fiber optic cable 44 that in turn is connected to the downhole device 18.

Although the optical downhole feedthrough system shown in FIG. 1 provides a means for establishing communications between an external monitoring and control system and a number of downhole fiber optic sensors, this system nevertheless suffers from the same disadvantages as the electrical cable-based system described above. In particular, because the feedthrough system requires a feedthrough port in the christmas tree, the pressure barrier provided by the christmas tree must be breached and the penetrator must be designed to include robust sealing systems for containing the wellbore pressure.

An embodiment of an optical downhole feedthrough system which does not require a penetration through the pressure barrier is discussed in U.S. Pat. No. 7,845,404, which is hereby incorporated herein by reference. In this embodiment, an optical downhole feedthrough device which is mounted to a christmas tree comprises an optically transparent window and optical repeaters positioned on either side of the window. The window and optical repeaters allow optical signal to be communicated between entities located inside and outside the christmas tree without penetrating the pressure barrier.

SUMMARY OF THE INVENTION

In accordance with the present invention, these and other limitations in the prior art are addressed by providing a system for communicating optical signals between an external device which is located outside a tubing spool that is positioned at the upper end of a wellbore and a downhole device which is located in the wellbore. In accordance with one embodiment of the invention, the system comprises a first wireless node which is positioned adjacent an outer surface portion of the tubing spool and is in communication with the external device via a fiber optic first cable. A tubing hanger is landed in the tubing spool and a second wireless node is positioned in the tubing hanger generally opposite the first wireless node. The first and second wireless nodes are configured to communicate wirelessly through the tubing spool using near field magnetic induction (NFMI) communications. The tubing hanger comprises a feedthrough bore which extends generally axially from proximate the second wireless node to a bottom wall portion of the tubing hanger. A third wireless node is positioned in the tubing hanger on a first side of the bottom wall portion. The second and third wireless node are connected by a second cable which is positioned in the feedthrough bore. A fourth wireless node is positioned on a second side of the bottom wall portion generally opposite the third wireless node and is in communication with the downhole device via a fiber optic third cable. The third and fourth wireless nodes are configured to communicate wirelessly through the bottom wall portion using NFMI communications. A first optical converter is configured to convert optical signals received from the external device over the first cable into corresponding signals for wireless transmission by the first wireless node through the tubing spool to the second wireless node. The signals received by the second wireless node are transmitted over the second cable to the third wireless node for wireless transmission through the bottom wall portion to the fourth wireless node. In addition, a second optical converter is configured to convert the corresponding signals received by the fourth wireless node into optical signals for transmission over the third cable to the downhole device.

In this embodiment, the second optical converter may be configured to convert optical signals received from the downhole device over the third cable into corresponding signals for wireless transmission by the fourth wireless node to the third wireless node. The signals received by the third wireless node are transmitted over the second cable to the second wireless node for wireless transmission to the first wireless node. In addition, the first optical converter is configured to covert the corresponding signals received by the first wireless node into optical signals for transmission over the first cable to the external device.

The second wireless node may be positioned behind an outer diameter wall portion of the tubing hanger, in which event the first and second wireless nodes are configured to communicate wirelessly through both the tubing spool and the outer diameter wall portion using NFMI communications.

In accordance with another embodiment of the invention, an apparatus is provided for communicating optical signals between an external device located on a first side of a wellbore barrier and a downhole device located on a second side of the wellbore barrier. The apparatus comprises a first wireless node which is positioned on the first side of the wellbore barrier and is in communication with the external device via a first cable. A second wireless node is positioned on the second side of the wellbore barrier and is in communication with the downhole device via a second cable. The first and second wireless nodes are configured to communicate wirelessly through the wellbore barrier using NFMI communications. Also, at least one of the first and second cables comprises a fiber optic cable and the apparatus further comprises a first optical converter which is configured to convert optical signals on the fiber optic cable into electrical signals for wireless transmission by the corresponding first or second wireless node through the wellbore barrier.

In this embodiment, each of the first and second cables may comprise a respective fiber optic cable. In this case, the first optical converter is connected to the first cable and the apparatus further comprises a second optical converter which is configured to convert optical signals on the second cable into electrical signals for wireless transmission by the second wireless node.

Also, the wellbore barrier may comprise a tubing spool, the first wireless node may be positioned adjacent an outer surface portion of the tubing spool and the second wireless node may be positioned adjacent an inner surface portion of the tubing spool generally opposite the first wireless node.

Alternatively, the wellbore barrier may comprise a tubing spool in which a tubing hanger is landed, the first wireless node may be positioned adjacent an outer surface portion of the tubing spool and the second wireless node may be positioned in the tubing hanger generally opposite the first wireless node. In this case, the second wireless node may be positioned behind an outer diameter wall portion of the tubing hanger and the first and second wireless nodes may be configured to communicate wirelessly through both the tubing spool and the outer diameter wall portion using NFMI communications. Furthermore, the second wireless node may be connected to a fiber optic third cable which is positioned in an axial feedthrough bore in the tubing hanger and is connected to the second cable with a dry mate connector that is mounted to the tubing hanger.

Alternatively, the wellbore barrier may comprise a wellhead, the first wireless node may be positioned adjacent an outer surface portion of the wellhead and the second wireless node may be located inside the wellhead generally opposite the first wireless node. In this embodiment, the wellbore barrier may further comprise a christmas tree which is connected to the top of the wellhead by a tree connector and the first wireless node may be mounted to the tree connector. Also, an isolation sleeve may extend from the christmas tree into the wellhead and the second wireless node may be mounted to an inside surface portion of the isolation sleeve.

In accordance with yet another embodiment of the invention, an apparatus is provided for communicating signals wirelessly across a wellbore barrier defined by a tubing spool which is positioned at the top of a well bore and a tubing hanger which is landed in the tubing spool. The apparatus comprises a first wireless node which is positioned adjacent an outer surface portion of the tubing spool and is in communication with an external device. A second wireless node is positioned in the tubing hanger generally opposite the first wireless node and is in communication with a downhole device via a second cable which is positioned in an axial feedthrough bore in the tubing hanger. In this embodiment, the first and second wireless nodes are configured to communicate wirelessly through the tubing spool using NFMI communications. The second wireless node may be positioned behind an outer diameter wall portion of the tubing hanger, in which event the first and second wireless nodes are configured to communicate wirelessly through both the tubing spool and the outer diameter wall portion using NFMI communications.

In accordance with a further embodiment of the invention, the second cable comprises a fiber optic cable and the apparatus further comprises a first optical converter which is configured to convert the signals received by the second wireless node into optical signals for transmission over the second fiber optic cable. The first optical converter may also be configured to convert the optical signals received from the downhole device over the second cable into electrical signals for wireless transmission by the second wireless node through the tubing spool to the first wireless node.

The apparatus of this embodiment may further comprise a fiber optic third cable which is in communication with the downhole device and is connected to the second cable via a dry mate connector mounted to the tubing hanger proximate a lower end portion of the feedthrough bore.

In accordance with still another embodiment of the invention, the first cable comprises a fiber optic cable and the apparatus further comprises a second optical converter which is configured to convert optical signals received from the external device over the first cable into electrical signals for wireless transmission by the first wireless node through the tubing spool to the second wireless node. The second optical converter may also be configured to convert the signals received by the first wireless node into optical signals for transmission to the external device over the first cable.

In accordance with another embodiment of the invention, a lower end portion of the feedthrough bore is closed by a bottom wall portion of the tubing hanger and the apparatus further comprises a third wireless node which is positioned in the tubing hanger on a first side of the bottom wall portion and a fourth wireless node which is positioned on a second side of the bottom wall portion generally opposite the third wireless node. The third and fourth wireless nodes are configured to communicate wirelessly through the bottom wall portion of the tubing hanger using NFMI communications. In addition, the second wireless node is connected to the third wireless node via the second cable and the fourth wireless node is in communication with the downhole device via a third cable.

In this embodiment, the third cable may comprise a fiber optic cable, in which event the apparatus further comprises a first optical converter which is configured to convert the signals received by the fourth wireless node into optical signals for transmission over the third cable. The first optical converter may also be configured to convert the optical signals received from the downhole device over the third cable into electrical signals for wireless transmission by the fourth wireless node through the bottom wall portion of the tubing hanger to the third wireless node.

The first cable may also comprise a fiber optic cable, in which event the apparatus further comprises a second optical converter which is configured to convert optical signals received from the external device over the first cable into electrical signals for wireless transmission by the first wireless node through the tubing spool to the second wireless node. The second optical converter may also be configured to convert the signals received by the first wireless node into optical signals for transmission to the external device over the first cable.

In accordance with the method of the present invention, optical signals are communicated wirelessly through a wellbore barrier by converting the optical signals into corresponding electrical signals, transmitting the electrical signals wirelessly through the wellbore barrier using NFMI communications, and converting the transmitted signals back into optical signals.

The downhole feedthrough system of the present invention utilizes near field magnetic induction to establish communications with downhole devices through the wellbore barrier, thus eliminating the need to penetrate the pressure barriers in order to accommodate. The elimination of penetrators and tubing hanger feedthrough devices increases the integrity of the flow completion system and reduces the expense, design constraints and risks associated with such components. In addition, since the feedthrough system can be used to communicate optical signals, the flow completion system can employ an optic fiber sensing system to monitor a variety of wellbore parameters.

These and other objects and advantages of the present invention will be made apparent from the following detailed description, with reference to the accompanying drawings. In the drawings, the same reference numbers may be used to denote similar components in the various embodiments.

DETAILED DESCRIPTION OF THE INVENTION

The wireless downhole feedthrough system of the present invention will be described herein in the context of a generic flow completion system for producing oil and/or gas from a subsea well. Such systems typically include a number of mechanical pressure barriers which function to prevent fluids in the wellbore from escaping into the surrounding environment. For example, in a horizontal christmas tree system comprising a wellhead located at the top of the wellbore, a christmas tree mounted to the top of the wellhead and a tubing hanger landed in the christmas tree, each of these components provides a mechanical pressure barrier between the wellbore and the environment. As will be apparent from the following detailed description, the wireless downhole feedthrough system of the present invention is capable of communicating signals and power through these and other types of mechanical wellbore barriers without physically penetrating the barriers. Consequently, the invention does not compromise the pressure-containing ability of the barriers. As used herein, the term "wellbore barrier" should be interpreted to include any mechanical component of a flow completion system which normally functions to isolate the wellbore from the surrounding environment. Such components include, but are not limited to, wellheads, christmas trees, valve blocks, tree caps, tubing spools, tubing hangers, tubing strings, casing strings, flow loops, flow lines and pipelines, among others. Also, the term "tubing spool" should be interpreted to include a christmas tree, a wellhead or any other component in which a tubing hanger or similar such component may be landed.

Figure 1:
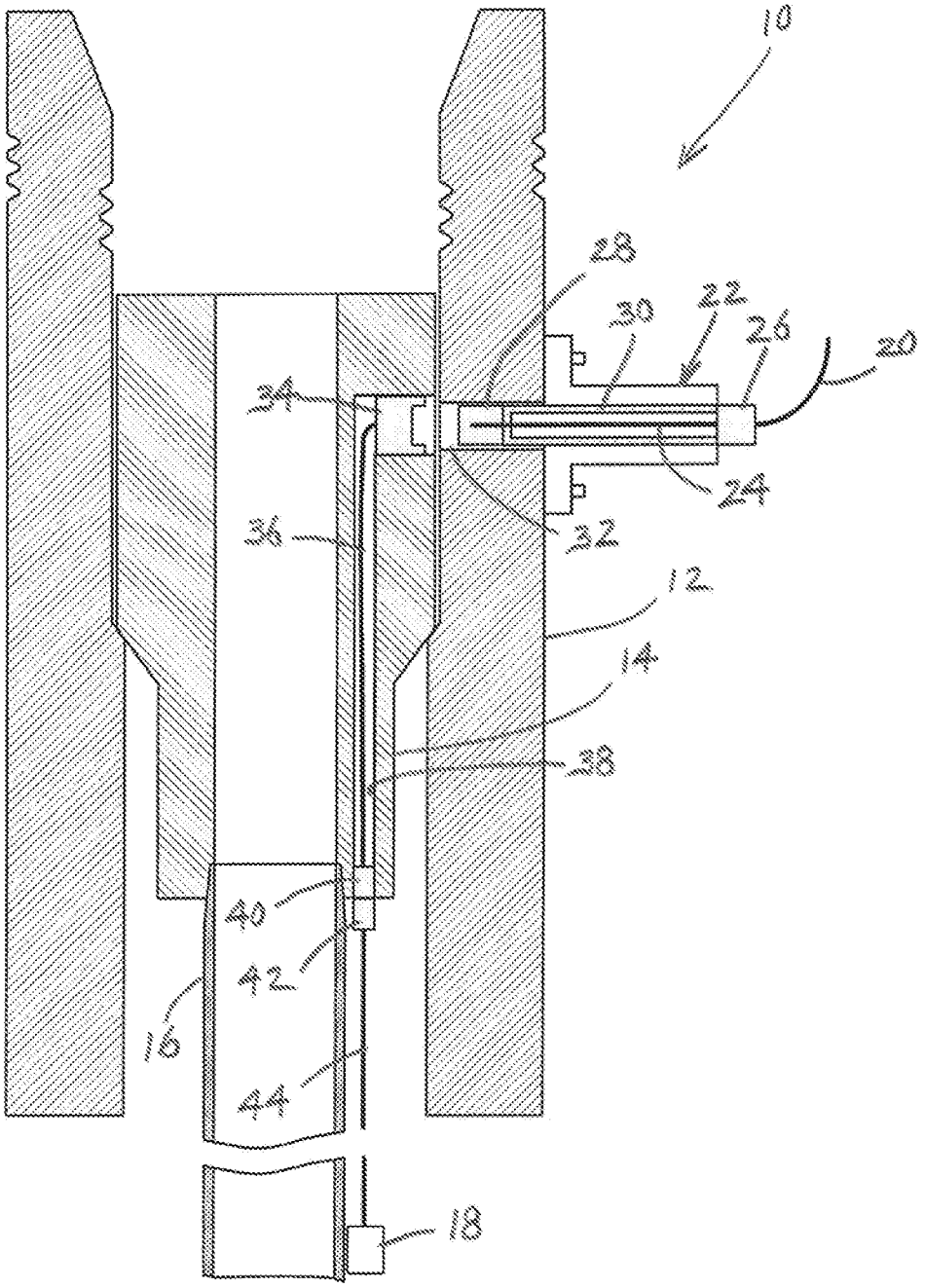
Fig. 1 (Prior Art)
FIG. 1 is a schematic representation of a prior art downhole feedthrough system shown installed in a representative wellhead assembly.
Figure 2:
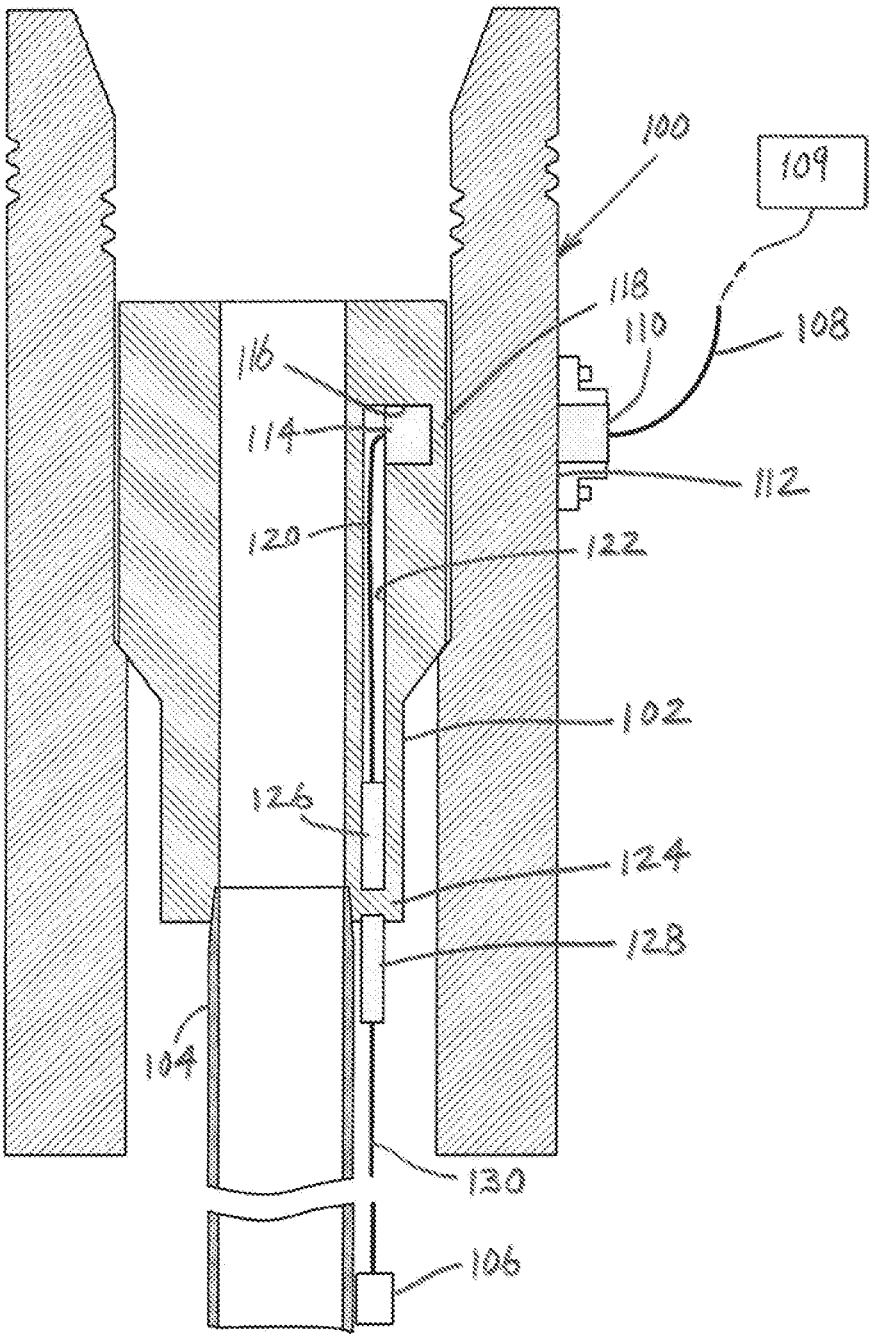
FIG. 2 is a schematic representation of a first embodiment of a wireless downhole feedthrough system of the present invention shown installed in a representative wellhead assembly.

A first embodiment of the wireless downhole feedthrough system of the present invention is shown in FIG. 2. The wireless downhole feedthrough system of this embodiment is shown installed on a representative flow completion system comprising a tubing spool in the form of a christmas tree 100 which is located at the upper end of a wellbore, a tubing hanger 102 which is landed in the christmas tree and a tubing string 104 which extends from the tubing hanger into the wellbore. In this embodiment, the wireless downhole feedthrough system is used to facilitate the communication of signals and/or power between a downhole device 106 and an external data and/or power cable 108 which is connected to an external device 109. The downhole device 106 may comprise any of a variety of devices which are normally used in flow completion systems. These may include, without limitation, actuators for operating valves and other mechanical components and sensors for monitoring various conditions of the wellbore fluid or the components of the flow completion system. Also, the external device 109 may comprise, for example, a control module, a signal repeater, a cable junction, or a cable connector, among other devices. In the context of the following description, the external device will be taken to be a conventional monitoring and/or control system which is located proximate the christmas tree 100 or on a surface vessel (not shown). Furthermore, the term "signals" should be interpreted to include not only data signals containing information representative of, e.g., various conditions of the wellbore fluid or the components of the flow completion system, but also control signals containing information which the monitoring and/or control system or the like may use to control certain downhole devices 106, such as valve actuators.

The external cable 108 is connected to a first wireless node 110 which is mounted by suitable means to an outer surface portion 112 of the christmas tree 100. The first wireless node 110 is wirelessly coupled in a manner which will be described below to a second wireless node 114 which is mounted in the tubing hanger 102 at a position located generally opposite the first wireless node when the tubing hanger is properly landed and locked in the christmas tree 100. In the embodiment of the invention shown in FIG. 2, the second wireless node 114 is positioned in a cavity 116 in the tubing hanger 102 which is closed by an outer diameter wall portion 118 that forms a solid wellbore barrier to the annulus between the christmas tree 100 and the tubing hanger.

The second wireless node 114 is connected to a feedthrough data and/or power cable 120 which is positioned in a feedthrough bore 122 that, in this embodiment of the invention, extends generally axially from the cavity 116 to, but not through, a bottom wall portion 124 of the tubing hanger 102. Thus, the bottom wall portion 124 forms a solid wellbore barrier between the feedthrough bore 122 and the annulus surrounding the tubing string 104.

The feedthrough cable 120 is connected to a third wireless node 126 which is positioned in the tubing hanger 102 between the bore 122 and the bottom wall portion 124. The third wireless node 126 is wirelessly coupled in a manner which will be described below to a fourth wireless node 128 which is mounted by suitable means to the bottom wall portion 124 generally opposite the third wireless node. The fourth wireless node 128 in turn is connected by a downhole data and/or power cable 130 to the downhole device 106.

In one mode of operation of the wireless downhole feedthrough system shown in FIG. 2, signals generated by the downhole device 106 are transmitted through the downhole cable 130 to the fourth wireless node 128. The fourth wireless node 128 processes the signals for wireless communication and wirelessly transmits the signals through the bottom wall portion 124 of the tubing hanger 102 to the third wireless node 126. The third wireless node 126 then processes the signals for wired communication and transmits the signals over the feedthrough cable 120 to the second wireless node 114. The second wireless node 114 then processes the signals for wireless communication and wirelessly transmits the signals through the outer diameter wall portion 118 of the tubing hanger 102 and the adjacent portion of the christmas tree 100 to the first wireless node 110. The first wireless node 110 then processes the signals for wired communication and transmits the signals over the external cable 108 to the monitoring and/or control system (not shown). The signals may similarly be transmitted in the reverse direction to provide for bidirectional communication between the monitoring and/or control system and the downhole device 106.

Thus, the embodiment of the wireless downhole feedthrough system shown in FIG. 2 allows for communication of signals between the exterior of the christmas tree 100 and the downhole device 106 without interfering with the wellbore barriers normally provided by the christmas tree 100 and the tubing hanger 102. The first and second wireless nodes 110, 114 transmit the signals wirelessly through the christmas tree 100 and the adjacent wall portion 118 of the tubing hanger 102, thereby eliminating the need for cable penetrations through these components. Likewise, the third and fourth wireless nodes 126, 128 transmit the signals wirelessly through the bottom wall portion 124 of the tubing hanger 102, thereby eliminating the need for a cable penetration through this wall portion. As a result, both the christmas tree 100 and tubing hanger 102 retain their normal pressure containing abilities.

Figure 3:
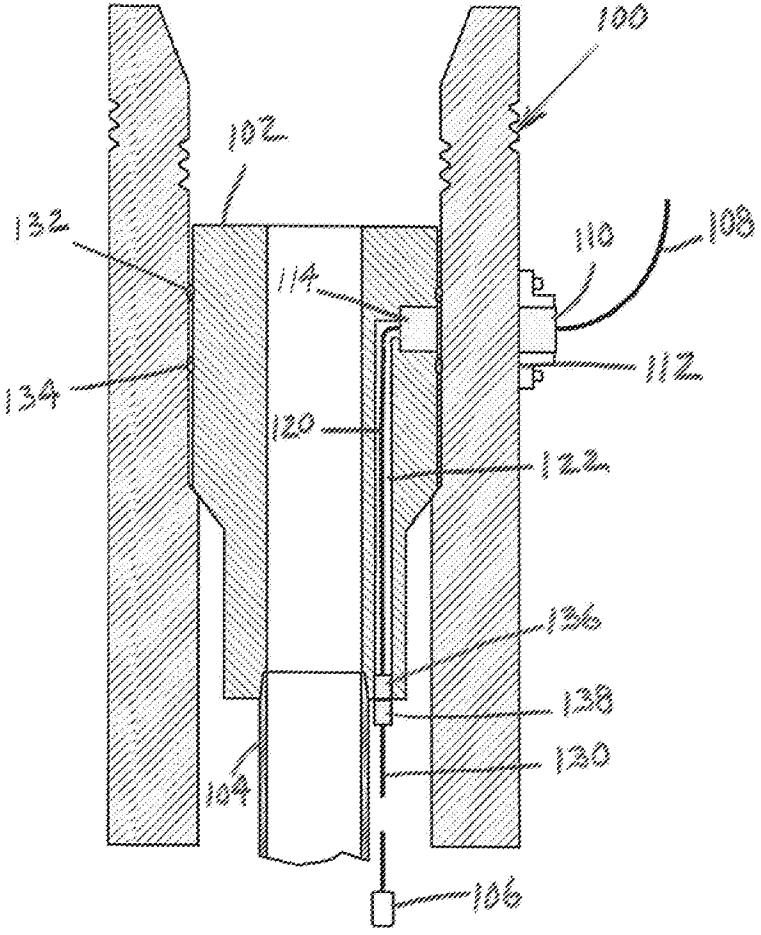
FIG. 3 is a schematic representation of a second embodiment of a wireless downhole feedthrough system of the present invention shown installed in a representative wellhead assembly.

A second embodiment of the wireless downhole feedthrough system of the present invention is shown in FIG. 3. In this embodiment, the outer diameter wall portion 118 of the tubing hanger 102 is eliminated and the second wireless node 114 is instead exposed to the annulus between the christmas tree 100 and the tubing hanger 102. However, the second wireless node 114 is isolated from pressure in the annulus by suitable upper and lower seals 132, 134. Thus, the only wellbore barrier between the first and second wireless nodes 110, 114 is the christmas tree 100. Due to the elimination of the second barrier defined by the wall portion 118 of the tubing hanger 102, the wireless downhole feedthrough system of FIG. 3 is capable of providing better data and/or power transfer efficiencies than the embodiment of FIG. 2.

In the embodiment of the invention shown in FIG. 3, the third and fourth wireless nodes 126, 128 present in the FIG. 2 embodiment are replaced by a pair of conventional dry mate connectors 136, 138. The upper dry mate connector 136 is mounted to the tubing hanger 102 by suitable means and is connected to the feedthrough cable 120. The lower dry mate connector 138 is secured to the upper dry mate connector 136 and is connected to the downhole cable 106. In this arrangement, the signals are communicated directly between the second wireless node 114 and the downhole device 106 without having to be processed for wireless communication.

Figure 4:
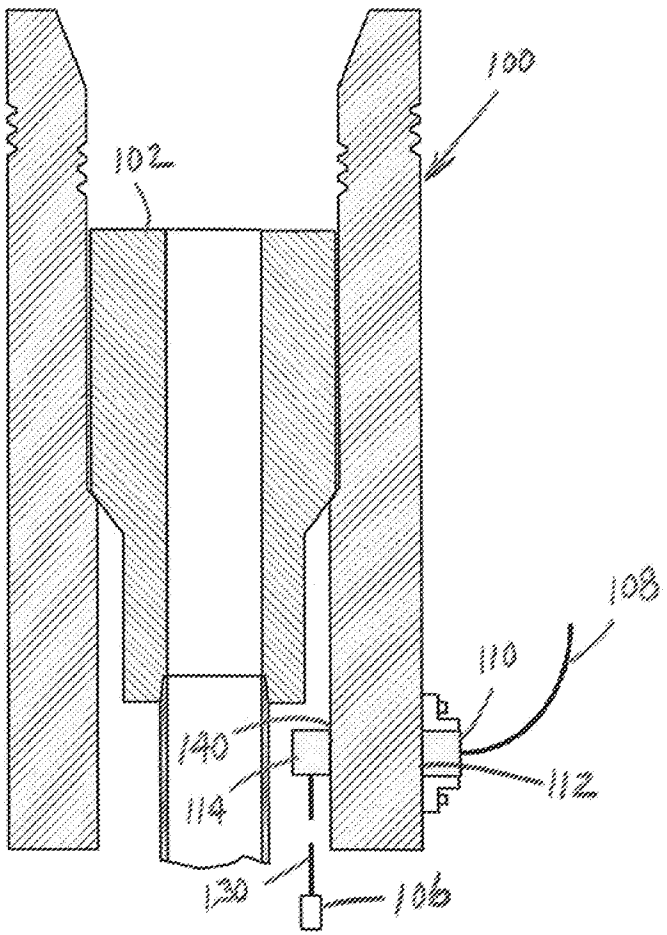
FIG. 4 is a schematic representation of a third embodiment of a wireless downhole feedthrough system of the present invention shown installed in a representative wellhead assembly.

A further embodiment of the wireless downhole feedthrough device of the present invention is shown in FIG. 4. In this embodiment, although the first wireless node 110 is mounted to an outer surface portion 112 of the christmas tree 100, the second wireless node 114, instead of being mounted in the tubing hanger 102, is mounted to an inner surface portion 140 of the christmas tree generally opposite the first wireless node. As a result, the tubing hanger 102 does not need to be configured to accommodate the second wireless node 114.

Figure 5:
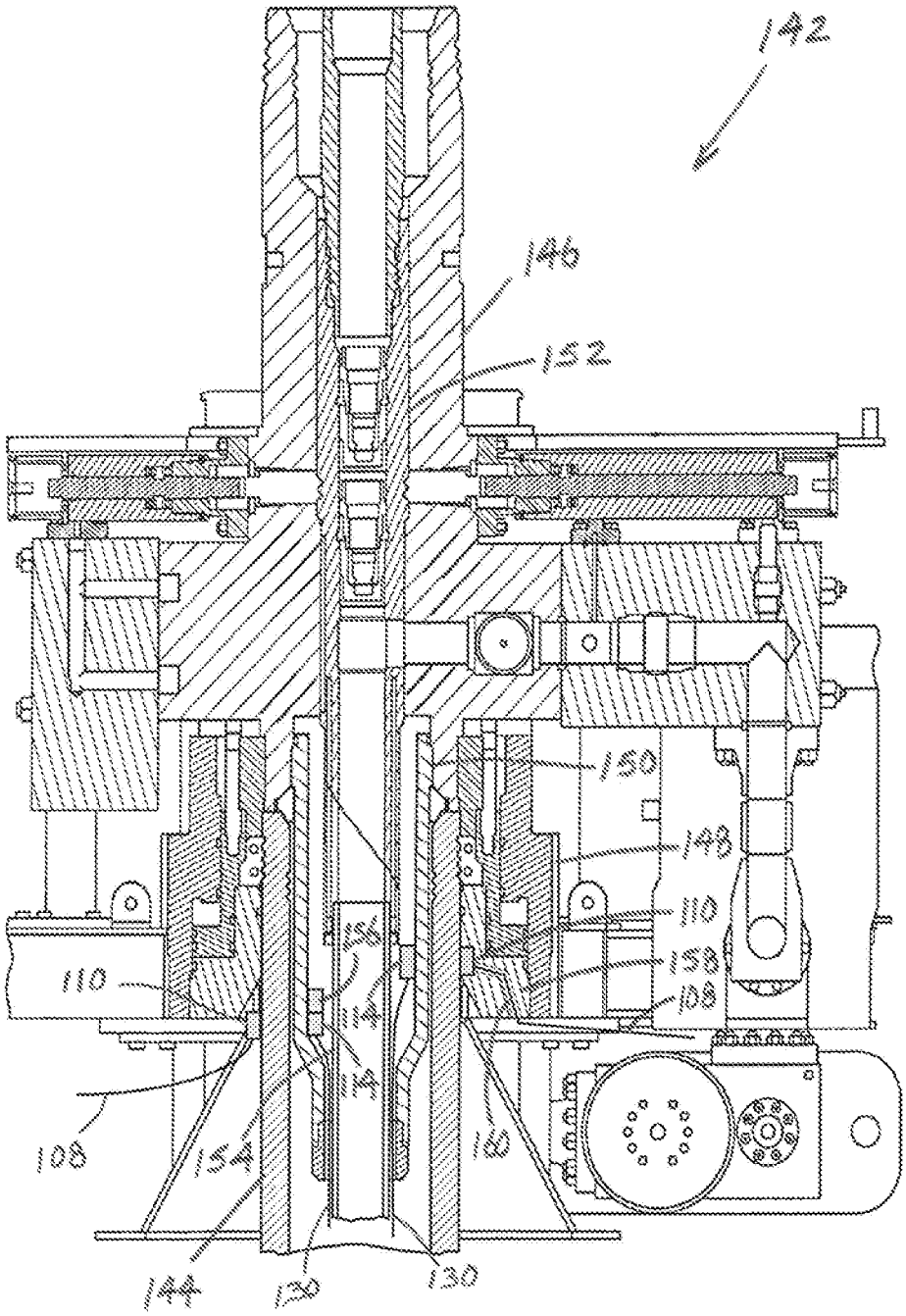
FIG. 5 is a schematic representation of a fourth embodiment of a wireless downhole feedthrough system of the present invention shown installed in a representative christmas tree assembly.

Referring to FIG. 5, further embodiments of the wireless downhole feedthrough device of the present invention are shown installed on an exemplary subsea completion system, indicated generally by reference number 142. The subsea completion system 142 comprises a wellhead housing 144 which is positioned at the upper end of a wellbore, a tubing spool in the form of a christmas tree 146 which is mounted to the top of the wellhead housing and is secured thereto by a conventional tree connector 148, an isolation sleeve 150 which extends from the christmas tree into the wellhead housing, a tubing hanger 152 which is landed in the christmas tree, and a tubing string 154 which is connected to the bottom of the tubing hanger and extends into the wellbore.

FIG. 5 depicts two different embodiments of the present invention. In the first embodiment, which is shown on the left-hand side of the flow completion system 142, the first wireless node 110 is mounted to an outer surface portion of the wellhead housing 144 and the second wireless node 114 is mounted to an inner surface portion of the isolation sleeve 150 generally opposite the first wireless node. As in the previous embodiments, the second wireless node 114 is connected to a downhole cable 130 which extends to a downhole device (not shown). In addition, the second wireless node 114 may be connected to an optional battery 156 for providing power to the second wireless node and/or the downhole device, if required.

In the second embodiment of the invention depicted in FIG. 5, which is shown on the right-hand side of the flow completion system 142, the first wireless node 110 is mounted to a preferably non-movable component 158 of the connector 148 which is located adjacent the outer surface of the wellhead housing 144. If required, the connector component 158 may be provided with a port 160 to enable the external cable 108 to connect to the first wireless node 110. As in the previous embodiment, the second wireless node 114 is mounted to an inner surface of the isolation sleeve 150 generally opposite the first wireless node 110 and is connected to a downhole cable 130 which extends to the downhole device (not shown).

In accordance with the present invention, the first and second wireless nodes 110, 114 and the third and fourth wireless nodes 126, 128 communicate using a near-field magnetic induction (NFMI) communications system. As described more fully in U.S. Patent Application Publication No. US 2008/0070499 A1, which is hereby incorporated herein by reference, the NFMI communications system transmits signals over a low power, non-propagating magnetic field. In particular, a transmitter coil in the transmitting wireless node generates a modulated magnetic field which is impressed upon a receiver coil in the receiving wireless node. Thus, unlike RF communications systems, which employ radio frequency electromagnetic waves, the NFMI communications system uses a purely magnetic field to transmit the signals between the pairs of wireless nodes 110, 114 and 126, 128. In accordance with the present invention, the NFMI communications system transmits the signals through the walls of the christmas tree 100 and/or the tubing hanger 102 by creating a localized magnetic field around each pair of wireless nodes 110, 114 and 126, 128. Consequently, no need exists to penetrate the christmas tree 100 and/or the tubing hanger 102 in order to accommodate data cables.

In certain embodiments of the invention in which power is required for the downhole device 106, the invention preferably employs an induction power transfer system to wirelessly transmit the power between the first and second wireless nodes 110, 114 and between the third and fourth wireless nodes 126, 128. Similar to NFMI communications systems, the induction power transfer system includes a magnetic field transmitter which is located in the transmitting wireless node and a magnetic field receiver which is located in the receiving wireless node. The magnetic field transmitter includes a transmitter coil which is wound around a transmitter core, and the magnetic field receiver includes a receiver coil which is wound around a receiver core. The magnetic field transmitter is connected to a signal generator which when activated generates a time varying current that flows through the transmitter coil. The flow of current through the transmitter coil generates a time varying magnetic field which propagates through the christmas tree 100 and/or the tubing hanger 102 to the magnetic field receiver located in the receiving wireless node. At the receiver, the time varying magnetic field flows through the receiver core and generates a current in the receiver coil which may then be used, e.g., to power the downhole device 106 or to charge a battery to which the downhole device is connected.

Figure 6:
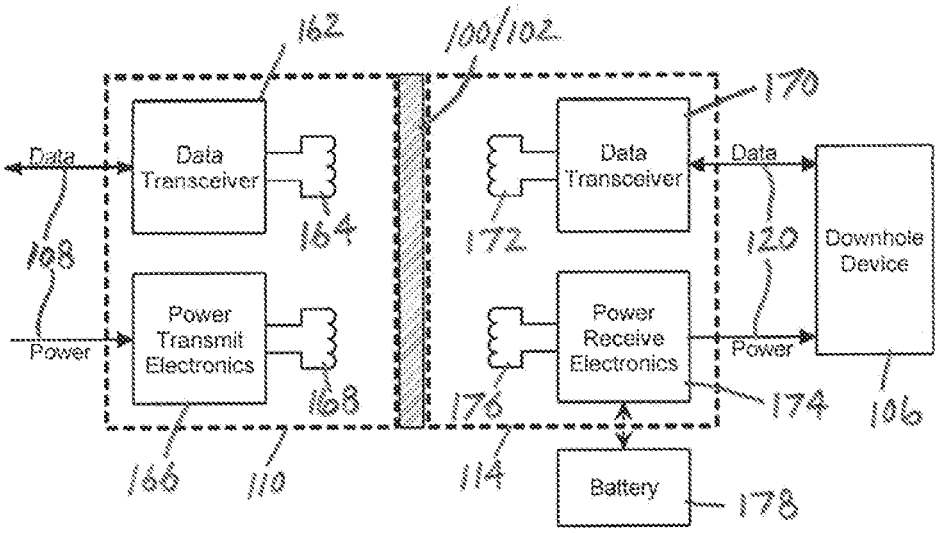
FIG. 6 is a first embodiment of an NMF communications and inductive power transfer transceiver system which is suitable for use in wireless downhole feedthrough systems, such as those shown in FIGS. 2-5.
Figure 7:
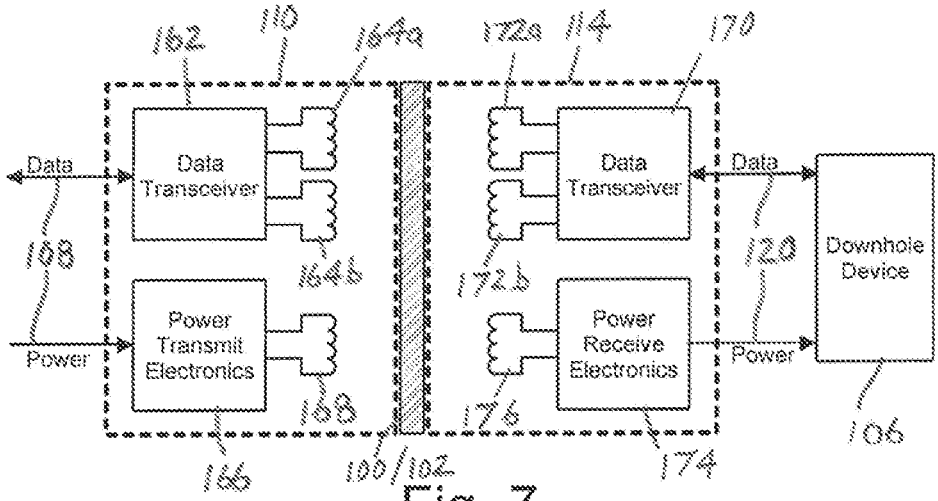
FIG. 7 is a second embodiment of an NMF communications and inductive power transfer transceiver system which is suitable for use in wireless downhole feedthrough systems, such as those shown in FIGS. 2-5.
Figure 8:
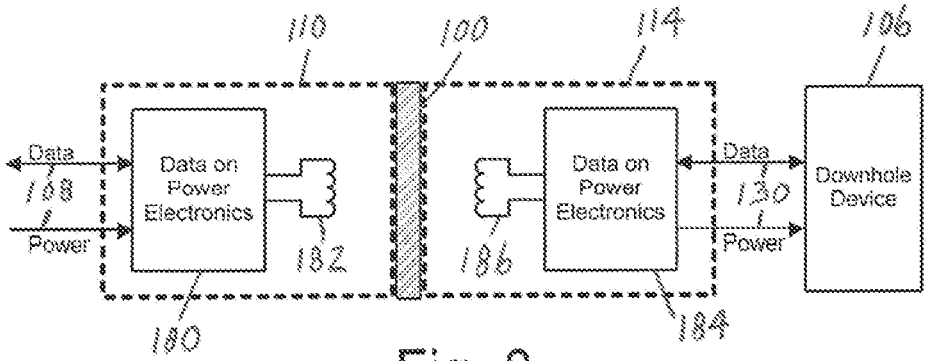
FIG. 8 is a third embodiment of an NMF communications and inductive power transfer transceiver system which is suitable for use in wireless downhole feedthrough systems, such as those shown in FIGS. 2-5.

Illustrative examples of wireless nodes 110, 114, 126, 128 which are configured for both NMFI communication and induction power transfer are show in FIGS. 6-8. In the embodiment shown in FIG. 6, the first wireless node 110 comprises a data transceiver 162 which includes a transmitter/receiver coil 164 and a power transmitter 166 which includes a transmitter coil 168. The data transceiver 162 and the power transmitter 166 are each connected to a corresponding data or power line in the external cable 108. The second wireless node 114 shown in FIG. 6 comprises a data transceiver 170 which includes a transmitter/receiver coil 172 and a power receiver 174 which includes a receiver coil 176. The data transceiver 170 and the power receiver 174 are each connected to a corresponding data or power line in the feedthrough cable 120. As described above, the feedthrough cable 120 may, e.g., be connected via the third and fourth wireless nodes 26, 28 and the downhole cable 130 to the downhole device 106. (The third and fourth wireless nodes 26, 28 and the downhole cable 130 have been omitted from FIG. 6 for purposes of simplification.) Although the data and power transceivers of each wireless node are shown in FIG. 6 to be located in a single package, they may alternatively be located in spatially discrete packages.

In one mode of operation of the wireless nodes 110, 114 depicted in FIG. 6, signals from the downhole device 106 are transmitted over the feedthrough cable 120 to the data transceiver 170 in the second wireless node 114. The data transceiver 170 includes suitable electronics for receiving the signals, modulating a suitable carrier signal with the signals to produce what will be referred to herein as "wireless signals", and driving the transmitter/receiver coil 172 with the wireless signals in order to generate a time varying magnetic field in accordance with the NFMI communications scheme described above. The magnetic field comprising the wireless signals propagates through the christmas tree 100 and/or the tubing hanger 102 and is impressed upon the transmitter/receiver coil 164 in the first wireless node 110, which in turn communicates the wireless signals to the data transceiver 162. The data transceiver 162 demodulates the wireless signals and transmits the resulting signals over the external cable 108 to the monitoring and/or control system (not shown). It should be understood that communication of signals from the monitoring and/or control system to the downhole device 106 is achieved in a similar fashion.

Power for the downhole device 106 may be provided by a suitable power supply located, e.g., on a surface vessel (not shown). The power is transmitted to the power transmitter 166 in the first wireless node 110 over a corresponding power line in the external cable 108. In accordance with the normal induction power transfer system, the power transmitter 166 includes conventional electronics for generating a time varying current which flows through the transmitter coil 168 and thereby causes the transmitter coil to generate a time varying magnetic field that propagates through the christmas tree 100 and/or the tubing hanger 102 to the receiver coil 176 in the second wireless node 114. The time varying magnetic field generates an alternating current in the receiver coil 176 which may be conditioned as desired by the power receiver 174. The power receiver 174 may then convey the desired current over a corresponding power line in the feedthrough cable 120 to the downhole device 106 (via, e.g., the third and fourth wireless nodes 26, 28 and the downhole cable 130).

The arrangement shown in FIG. 6 may include an optional battery 178 located in or adjacent the second wireless node 114 or the downhole device 106. The battery 178 may be used as a back-up powering device in case of failure of the induction power transfer system. Alternatively, the battery 178 may be used to store power for applications in which the downhole device 106 periodically requires higher power.

The wireless nodes 110, 114 shown in FIG. 7 are similar to those shown in FIG. 6. However, in the FIG. 7 embodiment the data transceiver 162 in the first wireless node 110 comprises separate transmitter and receiver coils 164*a*, 164*b* and the data transceiver 170 in the second wireless node 114 comprises separate transmitter and receiver coils 172*a*, 172*b*. This arrangement provides for simpler bidirectional NFMI communications between the first and second wireless nodes 110, 114 with less chance of interference between the modulated magnetic fields.

Referring to FIG. 8, each of the wireless nodes 110, 114 in this embodiment employs a data-on-power arrangement for transmitting/receiving both data and power using a single coil. In particular, the first wireless node 110 comprises a single data and power transceiver 180 which is connected to a single transceiver coil 182 and the second wireless node 114 comprises a single data and power transceiver 184 which is connected to a single transceiver coil 186. The data and power transmission in such a system may be achieved, for example, by time gating, in which the data is transmitted for a fixed period and the power is transmitted for a separate period. Alternatively, the data and power may be transmitted using different carrier frequencies.

Figure 9:
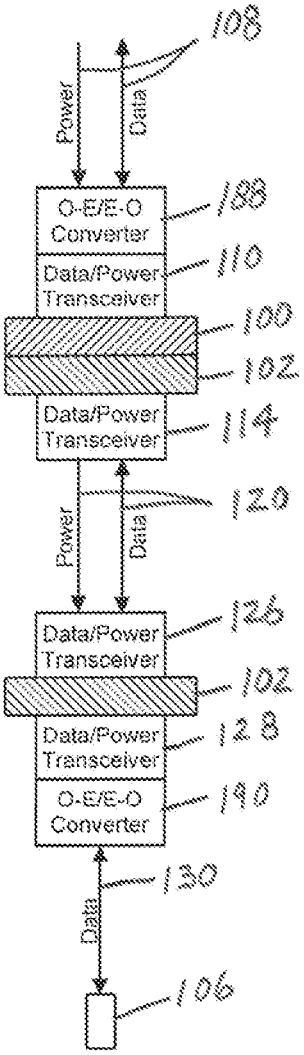
FIG. 9 is a schematic representation of one embodiment of an optical wireless downhole feedthrough system of the present invention.
Figure 10:
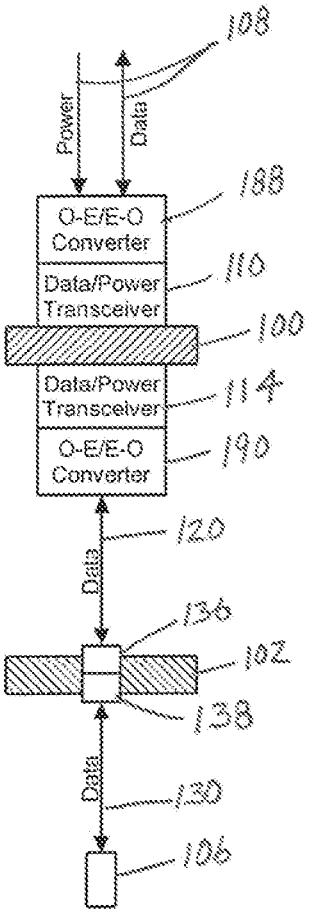
FIG. 10 is a schematic representation of a second embodiment of an optical wireless downhole feedthrough system of the present invention.
Figure 11:
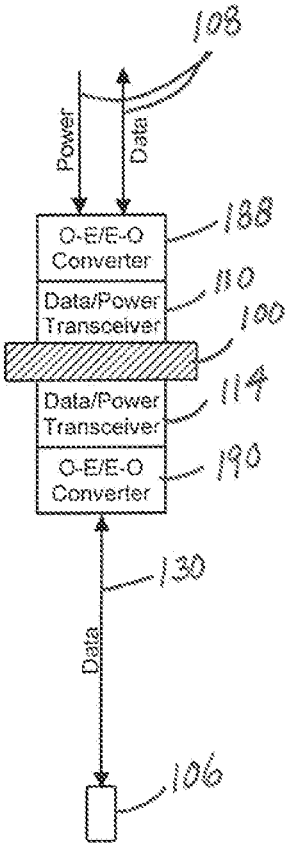
FIG. 11 is a schematic representation of a third embodiment of an optical wireless downhole feedthrough system of the present invention.

While the embodiments of the wireless downhole feedthrough system described above are primarily useful for communicating electrical-based signals between the downhole device and the monitoring and/or control system, further embodiments of the invention, which are shown schematically in FIGS. 9-11, are capable of communicating optical-based signals between these components. The optical wireless downhole feedthrough systems of these embodiments are especially useful when the downhole device comprises one or more optical sensors for monitoring certain conditions of the well, such as pressure, temperature and fluid composition. As described more fully in U.S. Pat. No. 7,845,404, an optical sensor can be any sensor which communicates using optical signals, including sensors which comprise sensing elements that are optical in nature and sensors which comprise sensing elements that are electrical or mechanical in nature and an interface that converts the sensed data to an optical signal. Examples of optical sensors which are useful for downhole condition monitoring include membrane deformation sensors, interferometric sensors, Bragg grating sensors, fluorescence sensors, Raman sensors, Brillouin sensors, evanescent wave sensors, surface plasma resonance sensors, and total internal reflection fluorescence sensors, among others.

FIG. 9 is a schematic representation of an embodiment of an optical wireless downhole feedthrough system which is suitable for use with the representative flow completion system depicted in FIG. 2. In this particular embodiment, the data line in each of the external cable 108 and the downhole cable 130 comprises one or more fiber optic cables while the data line in the feedthrough cable 120 comprises a conventional electrical cable. The optical wireless downhole feedthrough system of FIG. 9 may include many of the same components as the wireless downhole feedthrough system of FIG. 2, including wireless nodes 110, 114 for communicating through adjacent portions of the christmas tree 100 and tubing hanger 102 and wireless nodes 126, 128 for communicating through the bottom wall portion 124 of the tubing hanger. The optical nodes 110, 114, 126, 128 shown in FIG. 9 may therefore be similar to any of the optical nodes described with reference to FIGS. 6-8.

As shown in FIG. 9, each of the first and fourth wireless nodes 110, 128 is connected to or adapted to include a respective optical converter module 188, 190. Each of the first and second optical converter modules 188, 190 comprises electrical-to-fiber optic and fiber optic-to-electrical converters. The electrical-to-fiber optic converter units are configured to generate optical signals in a format commensurate with the requirements of the downhole sensor or communications device. Similarly, the fiber optic-to-electrical converter units are configured to detect the optical signals from downhole sensor or communications devices and convert them to appropriate electrical signals for wireless transmission. For communications from the monitoring and/or control system to the downhole device 106, the first optical converter module 188 functions to convert the optical signals received from the monitoring and/or control system over the external cable 108 into electrical signals which can then be transmitted wirelessly by the first wireless node 110 to the second wireless node 114 using NFMI communications. In addition, the second optical converter module 190 functions to convert the electrical signals received from the fourth wireless node 128 into optical signals which can then be transmitted over the downhole cable 130 to the downhole device 106. For communications from the downhole device 106 to the monitoring and/or control system, the second optical converter module 190 functions to covert the optical signals received from the downhole device over the downhole cable 130 into electrical signals which can then be transmitted wirelessly by the fourth wireless node 128 to the third wireless node 126 using NFMI communications. In addition, the first optical converter module 188 functions to covert the electrical signals received by the first wireless node 110 into optical signals which can then be transmitted on the external cable 108 to the monitoring and/or control system.

One mode of operation of the optical wireless downhole feedthrough system of FIG. 9 will now be described in connection with a downhole device 106 which comprises an optical sensor, such as a Bragg grating sensor, for measuring temperature. In this example, the monitoring and/or control system transmits an optical signal to the optical sensor, which in turn reflects the optical signal back to the monitoring and/or control system. The monitoring and/or control system can then determine the temperature of the environment of the optical sensor based on the change in wavelength between the transmitted signal and the reflected signal.

In operation, the monitoring and/or control system transmits an optical signal over the external cable 108 to the first optical converter module 188. The first optical converter module 188 converts the optical signal to a corresponding electrical signal, and the first wireless node 110 wirelessly transmits this signal through the christmas tree 100 and the tubing hanger 102 to the second wireless node 114. The signal from the second wireless node 114 is communicated over the electrical feedthrough cable 120 to the third wireless node 126, which wirelessly transmits the signal through the bottom wall portion 124 of the tubing hanger 102 to the fourth wireless node 128. The second optical converter module 190 then converts the signal from the fourth wireless node 128 to an optical signal which is transmitted over the downhole cable 130 to the downhole optical sensor 106.

The optical sensor 106 then reflects the optical signal back along the downhole cable 130 to the second optical converter module 190, which converts the reflected optical signal to a corresponding electrical signal that is wirelessly transmitted by the fourth wireless node 128 through the bottom wall portion 124 of the tubing hanger 102 to the third wireless node 126. The electrical signal is communicated from the third wireless node 126 over the electrical feedthrough cable 120 to the second wireless node 114, which wirelessly transmits the signal through the tubing hanger 102 and the christmas tree 100 to the first wireless node 110. The first optical converter module 188 then converts the electrical signal from the first wireless node 110 into a corresponding optical signal which is transmitted over the external cable 108 back to the monitoring and/or control system. The monitoring and/or control system then compares the wavelength of the original optical signal with the reflected optical signal to determine the temperature sensed by the downhole optical sensor 106.

FIG. 10 is a schematic representation of an embodiment of an optical wireless downhole feedthrough system which is suitable for use with the flow completion system depicted in FIG. 3. In this embodiment, the data line in each of the external cable 108, the feedthrough cable 120 and the downhole cable 130 comprises one or more fiber optic cables, and each of the first and second wireless nodes 110, 114 is connected to or adapted to include a respective optical converter module 188, 190. For communications from the monitoring and/or control system to the downhole device 106, the first optical converter module 188 functions to convert the optical signals received from the monitoring and/or control system over the external cable 108 into electrical signals which can then be transmitted wirelessly by the first wireless node 110 to the second wireless node 114 using NFMI communications. In addition, the second optical converter module 190 functions to convert the electrical signals received from the second wireless node 114 into optical signals which can be transmitted through the feedthrough cable 120, the dry mate connectors 136, 138 and the downhole cable 130 to the downhole device 106. For communications from the downhole device 106 to the monitoring and/or control system, the second optical converter module 190 functions to covert the optical signals received from the downhole device over the feedthrough cable 120 into electrical signals which can then be transmitted wirelessly by the second wireless node 114 to the first wireless node 110. In addition, the first optical converter module 188 functions to covert the electrical signals received by the first wireless node 110 into optical signals which can then be transmitted over the external cable 108 to the monitoring and/or control system.

FIG. 11 is a schematic representation of an embodiment of an optical wireless downhole feedthrough system which is suitable for use with the flow completion system depicted in FIG. 4. In this embodiment, the data line in each of the external cable 108 and the downhole cable 130 comprises one or more fiber optic cables and each of the first and second wireless nodes 110, 114 is connected to or adapted to include a respective optical converter module 188, 190. For communications from the monitoring and/or control system to the downhole device 106, the first optical converter module 188 functions to convert the optical signals received from the monitoring and/or control system over the external cable 108 into electrical signals which can then be transmitted wirelessly by the first wireless node 110 to the second wireless node 114 using NFMI communications. In addition, the second optical converter module 190 functions to convert the electrical signals received from the second wireless node 114 into optical signals which can be transmitted over the downhole cable 130 to the downhole device 106. For communications from the downhole device 106 to the monitoring and/or control system, the second optical converter module 190 functions to covert the optical signals received from the downhole device over the downhole cable 130 into electrical signals which can then be transmitted wirelessly by the second wireless node 114 to the first wireless node 110. In addition, the first optical converter module 188 functions to covert the electrical signals received by the first wireless node 110 into optical signals which can then be transmitted on the external cable 108 to the monitoring and/or control system.

Although the various embodiments of the wireless downhole feedthrough systems described above were shown as having a single downhole device 106, it should be understood that the invention can be readily adapted for use with multiple downhole devices. For example, in the embodiments of the optical wireless downhole feedthrough systems shown in FIGS. 9-11, the downhole cable 130 could comprise a separate fiber optic cable for each downhole device. In this example, each fiber optic cable may be provided with a suitable optical filter, such as a Bragg grating filter, to enable the monitoring and/or control system to communicate individually with each downhole device. Alternatively, the downhole cable 130 may comprise a single fiber optic cable which is connected to a plurality of the downhole devices. In this example, various multiplexing techniques, such as wavelength multiplexing or time domain multiplexing, may be used to enable the monitoring and/or control system to communicate individually with each downhole device.

It should be recognized that, while the present invention has been described in relation to the preferred embodiments thereof, those skilled in the art may develop a wide variation of structural and operational details without departing from the principles of the invention. For example, the various elements shown in the different embodiments may be combined in a manner not illustrated above. Therefore, the appended claims are to be construed to cover all equivalents falling within the true scope and spirit of the invention.

What is claimed is:

1. An apparatus for communicating signals across a wellbore barrier defined by a first flow completion system component positioned at an upper end of the wellbore and a second flow completion system component mounted within the first flow completion system component, the apparatus comprising:

a first wireless node which is mounted on the first flow completion system component on a first side of the wellbore barrier, the first wireless node being configured to be connected to an external device;

a second wireless node which is mounted on the second flow completion system component on a second side of the wellbore barrier, the second wireless node being located generally opposite the first wireless node and being configured to be connected to a downhole device;

wherein the first and second wireless nodes are configured to communicate wirelessly through the wellbore barrier using near field magnetic induction (NFMI) communications.

2. The apparatus of claim 1, wherein the first flow completion system component comprises a tubing spool, and wherein the first wireless node is positioned adjacent an outer surface portion of the tubing spool and the second wireless node is positioned adjacent an inner surface portion of the tubing spool generally opposite the first wireless node.

3. The apparatus of claim 2, wherein the second flow completion system component comprises a tubing hanger which is landed in the tubing spool, and wherein the second wireless node is positioned in the tubing hanger generally opposite the first wireless node.

4. The apparatus of claim 3, wherein the second wireless node is positioned behind an outer diameter wall portion of the tubing hanger.

5. The apparatus of claim 3, wherein the second wireless node is in communication with a downhole device via a cable which is positioned in an axial feedthrough bore in the tubing hanger.

6. The apparatus of claim 5, wherein a lower end portion of the feedthrough bore is closed by a bottom all portion of the tubing hanger, and wherein the apparatus further comprises:

a third wireless node which is positioned in the tubing hanger on a first side of the bottom wall portion, the third wireless node being connected to the second wireless node via the cable; and a fourth wireless node which is positioned on a second side of the bottom wall portion generally opposite the third wireless node;

wherein the third and fourth wireless nodes are configured to communicate wirelessly through the bottom wall portion of the tubing hanger using NFMI communications.

7. A method for communicating optical signals wirelessly through a wellbore barrier defined by a first flow completion system component positioned at an upper end of the wellbore and a second flow completion system component mounted within the first flow completion system component, the method comprising:

providing a first wireless node which is mounted on the first flow completion system component on a first side of the wellbore barrier, the first wireless node being configured to be connected to an external device;

providing a second wireless node which is mounted on the second flow completion system component on a second side of the wellbore barrier, the second wireless node being located generally opposite the first wireless node and being configured to be connected to a downhole device;

wherein the first and second wireless nodes are configured to communicate wirelessly through the wellbore barrier using near field magnetic induction (NFMI) communications;

converting optical signals from the external device into corresponding electrical signals;

using the first wireless node, transmitting the electrical signals wirelessly through the wellbore barrier using NFMI communications;

using the second wireless node, receiving the transmitted signals from the first wireless node; and converting the received transmitted signals back into optical signals.

8. The method of claim 7, further comprising:

providing a first optical converter which is connected to the external device via a first fiber optic cable, the first optical converter being connected to or included in the first wireless node; and providing a second optical converter which is connected to the downhole device via a second fiber optic cable, the second optical converter being connected to or included in the second wireless node;

wherein the step of converting the optical signals from the external device into corresponding electrical signals is performed by the first optical converter; and wherein the step of converting the received transmitted signals back into optical signals is performed using the second optical converter.

* * * * *